US005101188A

United States Patent [19]

Kelly et al.

[11] Patent Number: 5,101,188

[45] Date of Patent: * Mar. 31, 1992

[54] CONDITION RESPONSIVE SWITCHING APPARATUS

[75] Inventors: Ronald W. Kelly; Kennett R. Fuller, both of Morrison, Ill.

[73] Assignee: General Electric Company, Fort Wayne, Ind.

[ * ] Notice: The portion of the term of this patent subsequent to Jun. 26, 2002 has been disclaimed.

[21] Appl. No.: 505,964

[22] Filed: Apr. 6, 1990

Related U.S. Application Data

[62] Division of Ser. No. 415,662, Oct. 2, 1989, Pat. No. 4,937,549.

[51] Int. Cl.[5] ..... H01H 37/36

[52] U.S. Cl. ..... 337/309; 337/311; 337/320

[58] Field of Search ..... 337/309, 310, 311, 312, 337/313, 314, 317, 318, 319, 320, 321, 323, 115, 117

[56] References Cited

U.S. PATENT DOCUMENTS

| | | | |
|---|---|---|---|
| 2,537,431 | 1/1951 | Stickel . | |
| 2,741,099 | 4/1956 | Beane . | |
| 2,762,888 | 9/1956 | Jacobs . | |
| 2,968,275 | 1/1961 | Spiro . | |
| 3,100,383 | 8/1963 | Foster et al. . | |
| 3,105,362 | 10/1963 | Gould . | |
| 3,304,395 | 2/1967 | Slonneger . | |
| 3,454,919 | 7/1969 | Kulick . | |
| 3,510,860 | 5/1970 | Christman . | |
| 3,617,665 | 11/1971 | Berson . | |
| 3,631,685 | 1/1972 | Young . | |
| 3,648,214 | 3/1972 | Slonneger | 337/311 |
| 3,668,594 | 6/1972 | Kulick . | |
| 3,721,880 | 3/1973 | Neill . | |
| 3,735,069 | 5/1973 | Andresen . | |
| 3,924,213 | 12/1975 | Semple . | |
| 4,003,044 | 1/1977 | Richmond, Jr. . | |
| 4,118,610 | 10/1978 | Purssell et al. . | |
| 4,121,655 | 10/1978 | Hart . | |
| 4,163,129 | 7/1979 | Rossi et al. . | |
| 4,169,357 | 10/1979 | Kelley . | |
| 4,190,764 | 2/1980 | Decker . | |
| 4,194,102 | 3/1980 | Branson et al. . | |
| 4,214,136 | 7/1980 | Rossi et al. . | |
| 4,237,746 | 12/1980 | Rossi et al. . | |
| 4,278,855 | 7/1981 | Rossi . | |
| 4,301,661 | 11/1981 | Krewson, Jr. . | |
| 4,311,190 | 1/1982 | Walley . | |
| 4,346,564 | 8/1982 | Gemma et al. . | |
| 4,406,322 | 9/1983 | Rossi et al. . | |
| 4,490,708 | 12/1984 | Thompson et al. | 337/320 |
| 4,575,706 | 3/1986 | Heidman, Jr. . | |
| 4,621,502 | 11/1986 | Ibrahim et al. . | |
| 4,777,350 | 10/1988 | Crockett et al. . | |
| 4,937,549 | 6/1990 | Kelly et al. | 337/309 |

FOREIGN PATENT DOCUMENTS

| | | |
|---|---|---|
| 1558474 | 1/1980 | United Kingdom . |
| 2111203 | 6/1983 | United Kingdom . |

OTHER PUBLICATIONS

"*Series Temperature Control*", Ranco Information Bulletin No. 1531010, 1981.

*Primary Examiner*—Harold Broome

*Attorney, Agent, or Firm*—Ralph E. Krisher, Jr.

[57] ABSTRACT

A condition responsive switching apparatus with an alarm feature for use in refrigeration appliances, such as freezers or the like. The switching apparatus includes a contact operator which moves between first, second, and third positions in response to the pressure changes of a bellows. The bellows pressure increases and decreases in response to changes in temperature sensed at the appliance. The apparatus includes a first set of control contacts to provide energization of a compressor and a second set of alarm contacts to provide energization of an alarm circuit. The contact operator has a first dog which opens and closes the control set of contacts as the operator moves through a snap action increment of travel between the first and second positions. An alarm spring opposes the travel of a second dog of the contact operator beyond the second position with a preload force until the excess of the snap action energy of the operator is dissipated. The alarm spring, thereafter, opposes the contact operator with a spring gradient until the operator reaches the third position and closes the alarm contacts. The closure of the alarm contacts causes the energization of an alarm circuit which signals that the appliance temperature is in excess of the cycling temperature and that the failure of a system component is likely to have occurred.

22 Claims, 7 Drawing Sheets

CONDITION RESPONSIVE SWITCHING APPARATUS

This is a Divisional of application Ser. No. 07/415,662, filed Oct. 2, 1989 now U.S. Pat. No. 4,938,548.

FIELD OF THE INVENTION

The invention pertains generally to condition responsive switching apparatus and is more particularly directed to switching apparatus used in temperature responsive cold controls with alarm capability for freezers and the like.

BACKGROUND OF THE INVENTION

Temperature responsive switching apparatus, known commonly as cold controls, are used for refrigeration appliances, such as freezers and the like, to control the temperatures therein. These cold controls are customarily regulated by a switch which cycles a compressor on and off in response to the measurement of the temperature of the air contained at some point in the appliance by a temperature sensing means. When the temperature exceeds a certain point, the compressor is switched on to cool the appliance. When the temperature of the appliance has been cooled past or to a particular value, the compressor switches off until the cycle begins again when the temperature rises.

One problem with the control of the temperature of refrigeration appliances, particularly freezers, using cold controls is that there is no facile way of determining there has been a failure if a portion of the control system fails. Such appliances are kept closed and are automatic in their operation for long periods of time. Because they are unattended and unobstrusive in their operation, the cold control, the compressor, or other system components may fail and the contents of a freezer become defrosted before anyone is alerted to the situation. With freezers of the commercial variety this can be especially detrimental because of their large capacity. Many foodstuffs which are stored in commercial freezers cannot be refrozen and must be disposed of once they have been thawed.

To alleviate this problem, some in the art have proposed alarm systems to warn when a freezer has quit operating. For example, Rossi, et al. in U.S. Pat. No. 4,510,480 and GB application 2,111,203A describe auxiliary and warning switches used in conjunction with a cycling control switch for refrigeration appliances. Andresen in U.S. Pat. No. 3,735,069 further describes a fault indicator switch used in conjunction with a thermostatic control having a snap-action switch.

These alarm systems must work in concert with the cold controls to cycle the apparatus back and forth between the operating temperatures and must also sense when the appliance has stopped working properly. Such alarm systems should be inexpensive to add to cold controls and should be readily integrated into such controls without major changes in control philosophy or structure. They should also exhibit robustness and reliability in operation. Another important criterion is the ability to interface with other cold control features, such as defrost cycles, without producing false alarms.

One popular cold control contains a U-shaped snap-acting spring which is used in the compressor cycling portion of the control. This control is highly advantageous in that it is simple and reliable because the snap action provides a sure switching action which is dependable for many cycles of the control. The control is also very robust because of the high energy content of the switching action which, once the spring constant of the U-shaped spring has been overcome, snaps the switch operator from a first position to a second position or back. The energy of the snap-action is absorbed by stationary stops at the two extreme positions. While making the switching action very sure, the energy absorbing stops do cause difficulties in designing additional features for the cold control. They limit movement and, therefore, temperature based force generation and actuation beyond these two positions by the switch operator.

Examples of this general type of control are disclosed in U.S. Pat. No. 3,065,323 issued to C. Grimshaw, U.S. Pat. No. 3,065,320 issued to R. W. Cobean, U.S. Pat. No. 3,096,419 issued to L. J. Howell, U.S. Pat. No. 3,354,280 issued to J. L. Slonneger, U.S. Pat. No. 3,648,214 issued to J. L. Slonneger, and U.S. Pat. No. 4,490,708 issued to Thompson, et al. All of these patents are assigned to the General Electric Company, the assignee of the present invention, and their disclosure is hereby expressly incorporated herein by reference.

It would be to great advantage to provide a cold control with a snap-action switch including an alarm feature which could be integrated into the switching mechanism without changing the advantages and control philosophy of the snap-action of the apparatus.

SUMMARY OF THE INVENTION

A preferred embodiment of the present invention includes a condition responsive switching apparatus with an alarm feature for use in refrigeration appliances, such as freezers or the like.

The switching apparatus includes a contact operator which cycles between first and second positions, and moves to a third position in response to a condition responsive element, preferably a temperature sensor. The contact operator effects operation of a first set of contacts which produces the cycling of a compressor as the contact operator moves between the first and second positions. The first set of contacts, a control contact set, includes a contact element mounted or staked to a stationary electrode and a contact element mounted or staked to a moveable arm. The contact operator further effects operation of a second set of contacts which provides for the energization of an alarm feature. The second contact set, an alarm contact set, includes a contact element mounted or staked to a stationary electrode and a contact element mounted or staked to a moveable arm.

The contact operator has a first means which opens and closes the control contact set as the operator moves through a snap-action increment between the first and second positions. An alarm spring forming the moveable arm of the alarm contact set opposes the travel of a second means of the contact operator beyond the second position with a preload force until the excess of the snap-action energy of the operator is dissipated. The alarm spring thereafter opposes the contact operator with a spring gradient until the operator reaches the third position and closes the alarm contact set. The closure of the alarm contacts causes the energization of an alarm circuit which signals that the appliance temperature is in excess of the cycling temperature and that the failure of a system component is likely to have occured.

Preferably, the switching apparatus forms a three terminal device where one terminal can be connected to a compressor and one of the control contacts, a second terminal can be connected to an alarm circuit and one of the alarm contacts, and the a third terminal can be connected to a power supply and the other control and alarm contacts. Preferably, the stationary alarm contact arm provides a mounting for the moveable arm of the control contact. Because each contact set has an independent stationary element and moveable element, a separate calibration for each contact set can be provided. An advantageous configuration is thereby formed whereby a change in one contact set, for example, erosion due to the cycling of the control contact set, does not change the calibration of the alarm contact set. This is important in an alarm feature where the alarm contact set is seldom needed, if at all, during the useful life of an appliance, but must maintain an exact alarm temperature calibration over that long period of time.

Additionally, the contact operator moves on the basis of temperature and not the position of the control contact elements. Therefore, failure of the system to remain below the alarm temperature, whether the control contact set is open or closed, will cause an alarm to be given. To allow the contact operator freedom to move based on temperature alone, while retaining the snap-action of the control contact is difficult. The upper temperature stop which normally absorbs the energy of the snap-action from the first to second position has been removed to allow further temperature based movement. The alarm spring with the preload must absorb the energy of the contact operator as it moves with its snap-action increment to the second position. The preload on the spring creates a force curve which very quickly absorbs energy and then allows the alarm spring to work through its normal gradient action.

The preferred arrangement being described further contains means to adjust the distance between the alarm contacts and means to adjust the preload force on the alarm spring to provide an adjustable alarm calibration. The means to adjust the distance between the alarm contacts is implemented by a set screw threadably positioned to bear against the moveable contact arm of the alarm spring. The means to adjust the preload force is implemented in a first embodiment by a set screw threadably positioned between the mounting of the moveable arm and the distance set screw which bears down on the alarm spring. The means to adjust the preload force is implemented in a second embodiment by a set screw threadably positioned between the mounting of the moveable arm and the distance set screw which bears upon the alarm spring. The first embodiment is used to increase a base preload force to provide the adjustable alarm calibration and the second embodiment is used to decrease a base preload force to provide the adjustable alarm calibration.

These and other objects, features, and aspects of the invention will become clearer and more fully detailed when the following detailed description is read in conjunction with the appended drawings wherein:

DETAILED DESCRIPTION OF THE PREFERRED EMBODIMENTS

Figure 1:
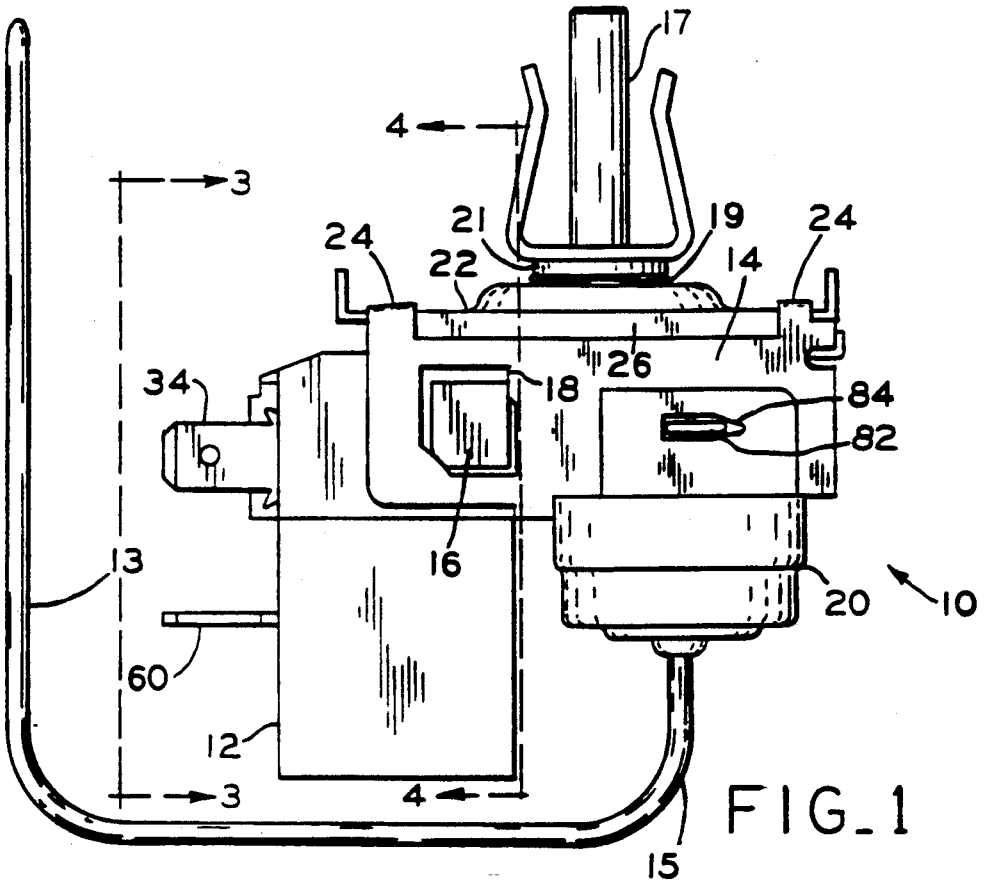
FIG. 1 is a side elevational view of a condition responsive switching apparatus constructed in accordance with the invention.

Referring now to FIG. 1, there is shown a condition responsive switching apparatus 10 constructed in accordance with the invention. Such apparatus is generally termed a cold control and is used for regulation of the temperature of refrigeration appliances, particularly freezers or the like. The illustrated implementation includes two sets of contacts, a control contact set for the energization of a compressor of a refrigeration cycle and an alarm contact set for the energization of an alarm circuit. In the present application, the implementations will be described as being particularly useful for a freezer appliance, but such an examples should be taken as merely illustrative of the invention and not limiting.

The switching apparatus 10, forming a three terminal electro-mechanical device, includes an insulating base or housing 12 which, for example, may be formed of molded phenolic thermosetting plastic and a U-shaped frame 14, which is formed of a suitable material such as stainless or plated steel. The frame 14 is securely mounted to the base 12 by suitable means, such as posts 16, which extend outwardly from each side of the base and are received in mating openings 18 of the frame. The frame 14 supports a bellows assembly 20 and a cover assembly 22 which includes means for mounting the switching apparatus 10 on a suitable supporting panel of the appliance.

The base 12, frame 14, bellows assembly 20, and cover 22 are securely joined together to form the outer covering of the switching apparatus 10 for mounting and protecting the various operating elements, such as the two sets of contacts. The assembly of such elements includes the posts 16 which are received in the mating openings 18 and the frame 14 formed with tabs 24 which are bent over the cover 22. The cover 22 also includes side flaps 26 which fold over the frame. The cover 22 is then crimped to the frame 14. Other details and one manner of assembling similar components are disclosed in the above mentioned Grimshaw patent literature. The details of the assembly will not be described further as they are conventional and do not form part of the present invention.

The bellows assembly 20 is responsive to a condition sensor, capillary tube 13, which is suitably placed in a refrigeration appliance. The bellows assembly 20 connects to the capillary tube 13 through a conduit 15 to communicate pressure differences in the tube based on a physical condition, usually temperature. In accordance with the sensed condition and an operator settable member, such as rotatable shaft 17, the switching apparatus 10 will control the connections between three terminals 34, 40 (not visible), and 60 with the two contact sets.

Figure 2:
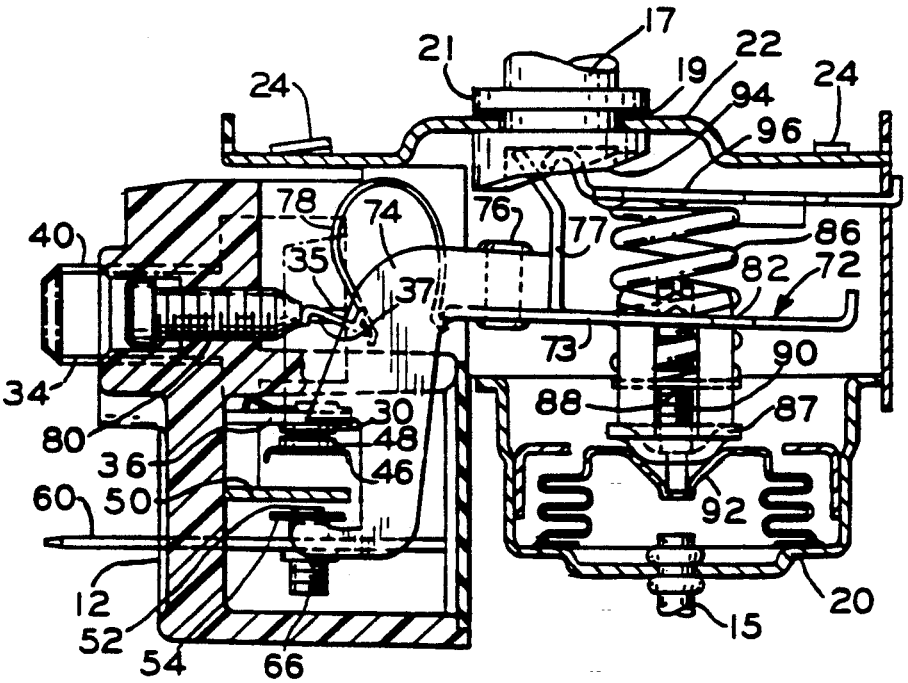
FIG. 2 is a partial cross-section and partial break away side elevation view of a first embodiment of the condition responsive switching apparatus illustrated in FIG. 1 showing certain operational aspects of the apparatus.
Figure 3:
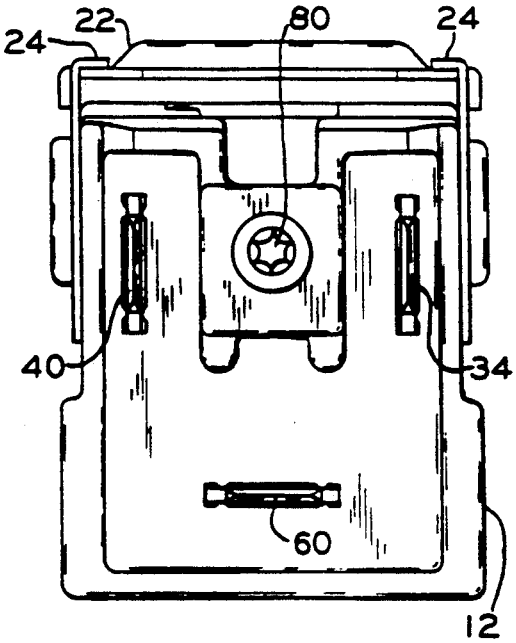
FIG. 3 is an obverse end view of the condition responsive switching apparatus illustrated in FIG. 1 taken along view lines 3—3 of that figure.
Figure 4:
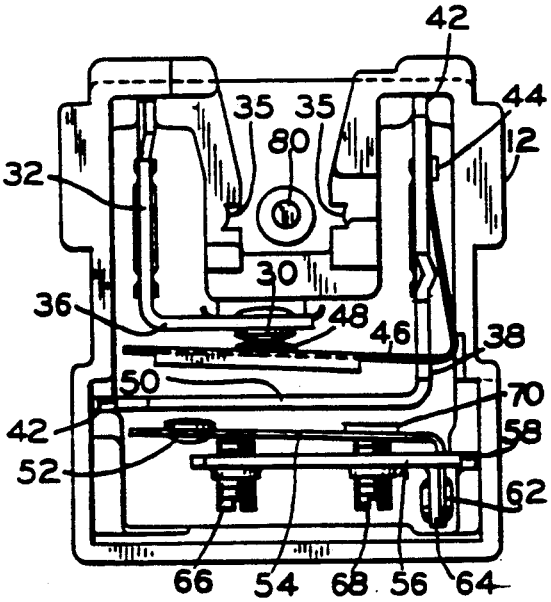
FIG. 4 is a reverse end view of the insulative base section of the first embodiment of the condition responsive switching apparatus illustrated in FIG. 1, with some parts removed to show certain operational aspects of the apparatus, taken along view lines 4—4 of that figure.

As better illustrated in FIGS. 2, 3 and 4, the base 12 forms a housing which has a cavity for mounting the contact sets of the switching apparatus 10 and their associated terminals 34, 40, and 60. A first set of contacts, a control contact set, is formed of a first contact element 30 mechanically and electrically connected to a stationary electrode plate 32. The electrode plate 32 is integrally formed with an electrode having an L-shaped arm 36 connecting the plate to the terminal prong 34 which exits the base 12. A second electrode is formed by a conductive L-shaped plate 38 which is right angled to the terminal 40 which exits the base 12. The ends of the electrode plate 38 are supported in slots 42 molded in the base 12. Welded to the electrode plate 38 at 44 and extending through a cut out in the plate is a moveable arm in the form of a leaf spring 46 which carries a first moveable contact element 48. The leaf spring 46 is resiliently formed to normally hold the contact elements 30, 48 together to form a normally closed control switch. A contact operator 72 moves from a second position to a first position (FIG. 2) open the control switch.

In the first preferred embodiment, a second switch, an alarm switch, is formed by the transverse arm 50 of the electrode plate 38 and a second moveable contact element 52. The transverse arm 50 forms a second stationary contact element (which can be a separate contact or the plated surface of the arm) electrically connected to the same terminal 40 as the first moveable contact element. This terminal 40 is used conveniently as the common power terminal for each switch. The second moveable contact element 52 is electrically and mechanically connected through a moveable arm 54 to a generally rectangular electrode plate 56 which is supported on one edge by a slot 58 molded into the base. The reverse edge of the electrode plate 56 is integral with the terminal 60 which exits the base 12. The moveable arm 54 of the second moveable contact 52 comprises an L-shaped alarm spring which is cantilevered from its mounting by a rivet 62 on a downwardly extending tab 64 of the plate 56. The moveable arm 54 is spaced away from the second stationary contact 50 and forms a normally open alarm switch. The alarm switch is closed as the contact operator 72 moves between its second position and a third position.

The closure distance between the alarm contact set 50, 52 can be adjusted by turning a set screw 66 which is threadably mounted in a bore of the electrode plate 56. The set screw 66 pushes the moveable arm 54 of the alarm spring toward the second stationary contact 50 to reduce the distance the contact operator must move between the second and third positions. Another set screw 68 is used to adjust a preload force on the moveable arm 54 of the alarm spring. The set screw 68 is threadably received in a bore of the electrode plate 56 and is located between the set screw 66 and the stationary cantilever support of the alarm spring at 62. The set screw 68 passes though an aperture in the alarm spring and has a head 70 which bears against the spring. The set screw 68 pulls the alarm spring against the set screw 66 to provide an adjustable preload on the alarm spring.

In this embodiment, the preload force increases from a base preload force as the set screw 68 is tightened down on the alarm spring 54. The preload force on the alarm spring 54 requires that the contact operator 72 overcome this force prior to moving the alarm spring. Once this force has been overcome, the alarm spring 54 opposes the movement of the contact operator 72 with its normal spring gradient during the transition from the second to the third positions.

Referring now particularly to FIG. 2, the actuation of both sets of contacts is provided by the contact operator 72 which includes a base portion 73 and a contact operating arm 74 secured thereto by a suitable means such as a rivet 76, so as to extend into the cavity of the base 12. The left end of the base portion 73 is supported by one end of a U-shaped snap-action toggle spring or toggle element 78. The other end of the snap-action spring 78 is supported by moveable pivot member 37 which is supported by means of a pair of channels 35. The channels 35 support the moveable pivot member 37 for longitudinal sliding movement within the base 12 so that its position can be adjusted by a differential adjusting screw 80. This provides a linearly moveable adjustable support for the left side of the toggle spring 78. The screw 80 is threadably received in the base 12 and bears against the side of the pivot member 37 remote of the toggle spring 78 so that by adjusting the position of the screw, the tension of the toggle spring 78 may be varied.

The operator 72 is also supported by means of a pair of shoulders 82, which extend outwardly from each side of the base portion 73 and are received in cooperating slots 84 formed in the U-shaped frame 14 (FIG. 1). Thus, the operator 72 is mounted for pivotal movement about the engagement of the shoulders 82 with the slots 84 with the toggle spring 74 continuously biasing the operator for movement in one direction, which is clockwise as seen in FIG. 2. Spaced slightly forward from the shoulders 82, the base portion 72 is provided with a pair of laterally disposed knife edges which provide arcuate pivots for supporting a bearing cup 87. The bearing cup 87 includes upper shoulders which fit upon the knife edges and depending parallel pairs of struts. At their other end, the struts support a cup shaped base. The knife edges, being positioned to the left of the pivot points of the shoulders 82, are used for providing a force on the operator tending to rotate the operator in a counterclockwise direction.

To this end, a range spring 86 engages, at its lower end, a nut 88 into which is threaded an adjusting screw 90. The lower portion of the screw 90 is provided with a shoulder portion which engages the base of the bearing cup 87. Also, the lower portion of the screw 90 extends through the base of bearing cup 87 and is received in a cup 92 of the bellows assembly 20. Thus, the range spring 86 acting through the nut 88 and screw 90 exerts a continuing force on the bearing cup 87, tending to rotate the operator 72 in the counter-clockwise direction. This force may be overcome by increasing the force which the bellows assembly 20 exerts on the lower end of the screw 90, which tends to reduce the force of the bearing cup 87 on the operator 72 against the force of the range spring 86, and rotate the operator in a clockwise direction.

The increase and decrease of the force of the bellows assembly 20 is utilized to provide a response to a condition external to the switching apparatus, such as a sensed temperature. To this end, the bellows assembly 20 is connected to the pinched capillary tube 13 by a means of the conduit 15 (FIG. 1). The capillary tube 13 contains a charge of a suitable refrigerant vapor such as, for example, dichlorodifluoromethane, butane or methylchloride. Thus, as the temperature of the capillary tube 13 rises or falls, the pressure of the vapor charge increases or decreases. This causes a corresponding increase or decrease in the force exerted on the screw 90 by the bellows assembly 20, all in a conventional manner. Thus, the pivotal movement of the operator 72 is responsive to a condition external to the switch and, in the cold control of the example, is in response to a temperature sensed by the capillary tube 13.

By varying the compression of range spring 86, the sensed temperature level at which the cold control operates may be adjusted. To accomplish this, there is provided a manual adjustment cam 94, which is rotatably supported on the cover 22 by the shaft 17 with a spring washer 19 captured between the cover 22 and a flange 21 formed on the shaft 17 to retain the shaft and cam in a preset angular position. The cam 94 engages one end of a cam follower 96, which is pivotably mounted on the U-shaped frame 14. The upper edge of the range spring 86 engages the underside of the cam follower 96 so that, as the cam follower 96 responds to the rotary position of the cam 94, the amount of compression of the range spring 86 between the cam follower 96 and the nut 88 is changed. An opening may be provided in the cover 22 and in a similar cover (not shown) for the cam follower 96 for the insertion of a screw driver to calibrate the mechanism by adjusting the screw 90.

The contact operator 72 further includes an upstanding tang 77 in contact with the cam 94 which is used in a defrost cycle. The operation of the shaft 17 to a defrost position angle causes a portion of the cam 94 to position the tang 77 so that the contact operator 72 is locked in the first position. This operation produces a defrosting of the refrigeration appliance as both sets of contacts will remain open independent of temperature. The compressor will remain off preventing a cooling cycle and the alarm circuit will remain off and not give a false alarm.

As thus far described, the toggle spring 78 exerts a continuing force on the operator tending to cause it to rotate in a clockwise direction and this force may be overcome by the range spring to move the operator in a counterclockwise direction. The force of the range spring 86 is opposed by the bellows assembly 20 and is effectively exerted on the operator 72 only when the temperature sensed by the capillary tube 13 is below a predetermined level so that the force of the bellows is reduced below a predetermined level.

Figure 5:
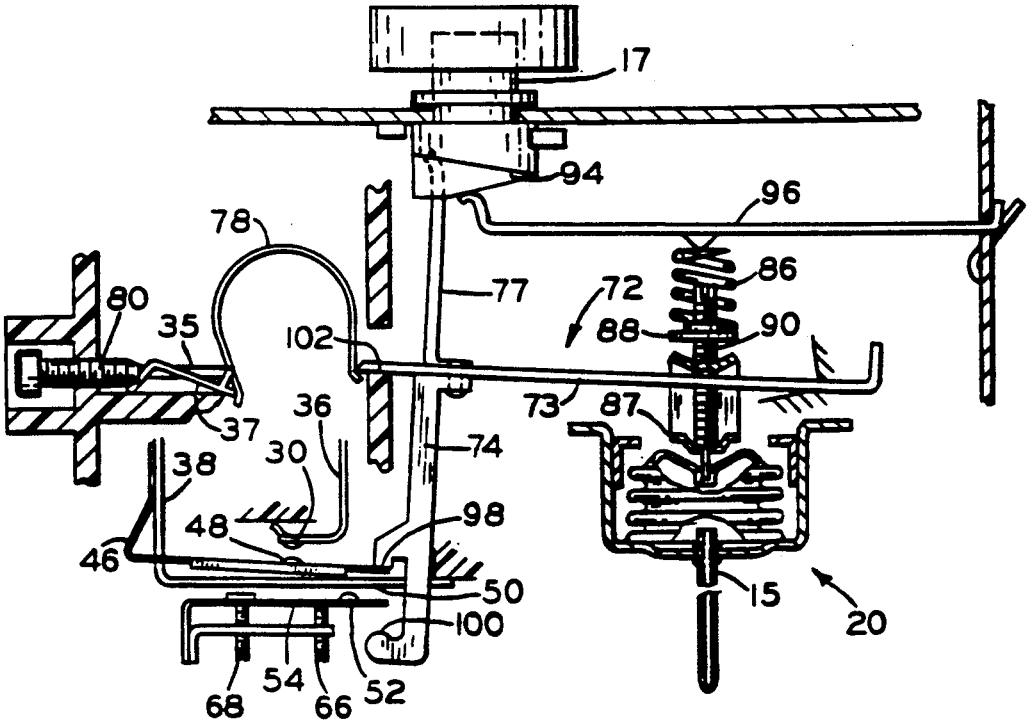
FIG. 5 is a semi-schematic representational side elevation view of the first embodiment of the condition responsive switching apparatus illustrated in FIG. 1 showing the contact operator in a first position.
Figure 6:
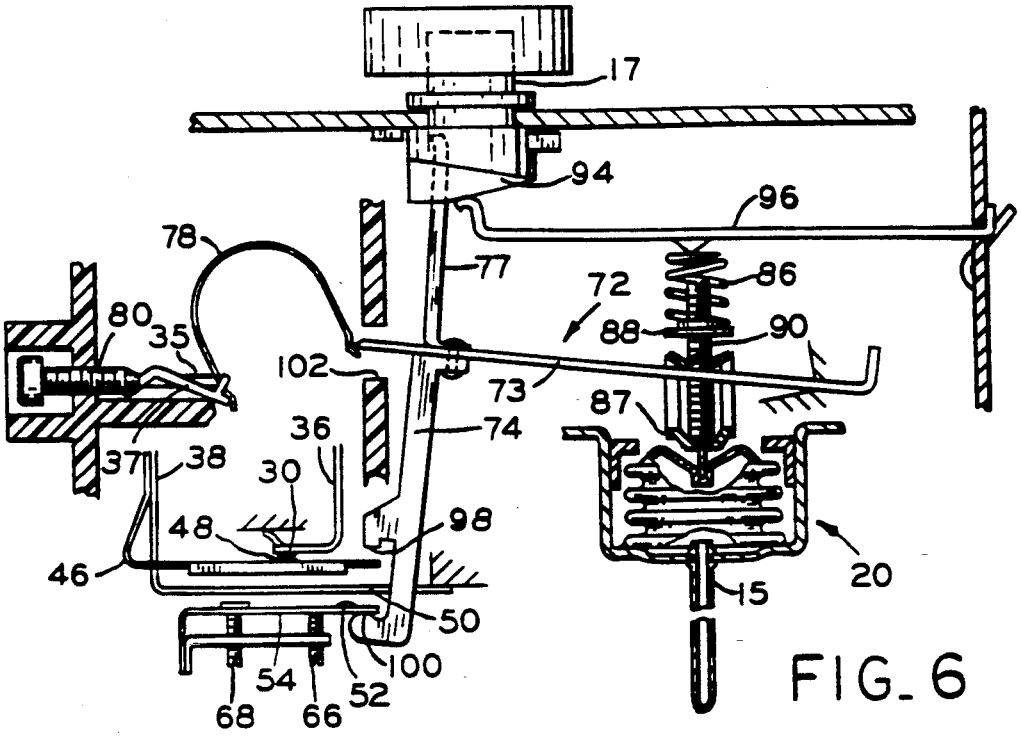
FIG. 6 is a semi-schematic representational side elevation view of the first embodiment of the condition responsive switching apparatus illustrated in FIG. 1 showing the contact operator in a second position.
Figure 7:
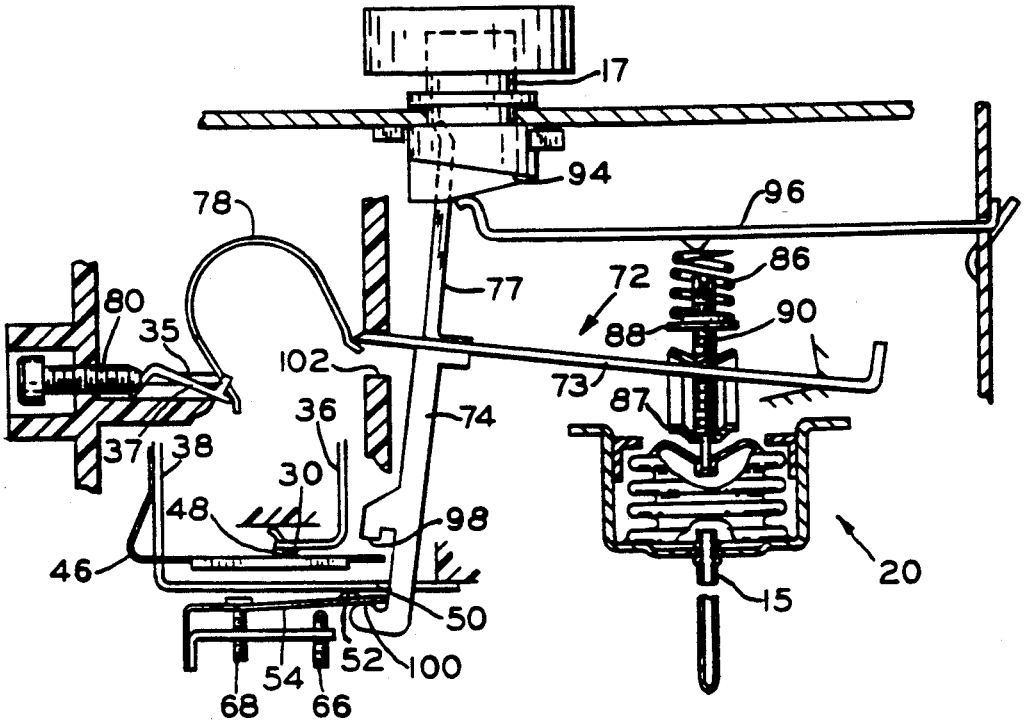
FIG. 7 is a semi-schematic representational side elevation view of the first embodiment of the condition responsive switching apparatus illustrated in FIG. 1 showing the contact operator in a third position.

The operation of the switching apparatus 10 relative to the two contact sets will now be more fully explained with reference to FIGS. 5–7 which illustrate the different operational positions of the apparatus. FIG. 5 illustrates the contact operator arm 72 of the apparatus 10 in a first position where the control contact set 30, 48 is open and the alarm contact set 50, 52 is open. FIG. 6 illustrates the contact operator arm 72 of the apparatus 10 in a second position where the control contact set 30, 48 is closed and the alarm contact set 50, 52 is open. FIG. 7 illustrates a third position of the contact operator arm 72 where the control contact set 30, 48 is closed and the alarm contact set 50, 52 is closed.

Assuming, for purposes of explanation, that the switching apparatus 10 is in the position shown in FIG. 5 and the capillary tube 13 senses an increasing temperature, the pressure of the vapor charge will increase. This causes an increase in the force exerted by bellows 20. This counters the force of range spring 86 and reduces the effective counterclockwise force exerted on operator 72. Eventually, at a predetermined elevated sensed temperature, the counterclockwise force will be overcome sufficiently such that toggle spring 78 will begin to pivot the operator 72 in a clockwise direction. As is well-known, the more the toggle spring 78 moves the operator 72 in this direction the stronger becomes the effective force exerted by the toggle spring. Thus, the operator is snapped in the clockwise direction to its second position as seen in FIG. 6.

Similarly, as the capillary tube 13 senses a falling temperature the vapor pressure and thus the force of bellows 20 is reduced, and the effective counterclockwise force exerted on the operator 72 by range spring 86 increases. Eventually, at a predetermined sensed temperature, the range spring 86 will begin to move the operator 72 in a counterclockwise direction against the toggle spring 78. As is well known, the more the operator 72 moves in this direction the weaker becomes the effective force exerted by the toggle spring 78. Thus, the operator 72 is snapped back to the first position shown in FIG. 5.

The particular temperature at which the bellows 20 will allow the range spring 86 to overcome the toggle spring 78 is determined by the setting of the cam 94 or the adjustment of screw 90. The differential adjusting screw 80 is used to set the differential temperature of the apparatus 10; that is the difference between the sensed temperature at which the operator will snap to the first position and the sensed temperature at which it will snap to the second position.

The operating arm 72 is formed to cooperate with the control contact set and to effect opening and closing of the control contacts in a predetermined manner as the operator 72 pivots in its two directions. To this end, the operating arm 74 extends into the chamber of the base 12 and includes a first portion or dog 98 which overlies the free end of the moveable arm 74. The operating arm also includes a second portion or dog 100 which underlies the alarm spring arm 54. The portions 98 and 100 are spaced apart a distance which is coordinated with the spacing of the moveable arms 46 and 54 to provide a proper sequence of operation for the sets of contacts 30, 48 and 50, 52.

More specifically, when the sensed temperature is at or above a predetermined level, so that the operator 72 has been pivoted to its second position, the dog 98 is out of engagement with the cooperating spring arm 46 and the control set of contacts are closed. The dog 100 is engaged with alarm spring 54, but the alarm contact set is open. As the sensed temperature decreases, the force of bellows 20 will decrease and the range spring 78, acting through the nut 88 and the screw 90, will exert an increasing counterclockwise force on the operator 72. At a predetermined sensed temperature, the effective counterclockwise force exerted on the operator 72 will be sufficient to overcome the toggle spring 78, and the operator will snap in a counterclockwise direction to the first position. This brings the dog 98 into engagement with spring arm 46 and opens the contact elements 30 and 48. The dog 100 is out of engagement with alarm spring 54 and the alarm contact set is open. The kinetic energy of the operator 72 which is produced by the snap-action to the first position is absorbed by the stationary stop 102.

If the sensed temperature then begins to rise, the force exerted by the range spring 86 will be counteracted by an increasing force of the bellows 20 and at a second slightly higher sensed temperature, the operator 72 will snap in a clockwise direction releasing the spring arm 46 so that the contact elements 30 and 48 are again closed. The kinetic energy of the snap action will be absorbed by the alarm spring 54. Thus, the contact elements 30 and 48 are opened and closed as the operator 72 moves through a snap action increment intermediate its first and second positions.

Assuming that after the contact elements 30 and 48 are closed in the second operator position, the sensed temperature continues to increase, i.e., the vapor pressure and the force of bellows assembly 20 increases. This causes an increasing effective clockwise force to be exerted upon the operator 72 and thus on the alarm spring 54. This force continues to increase unit it is sufficient to overcome the preload force and the gradient of the alarm spring. When the temperature increases to an alarm temperature, the contact operator 72 closes the contact elements 50 and 52.

The adjustable screw 90 sets the sensed temperature at which the spring arm 46 will snap to its contact open position while the adjustable screw 80, bearing against the toggle element 78, determines the temperature differential of the control contact set; that is the difference between the temperature at which the control elements open and the temperature at which they close.

The spacing between the spring arms 46 and 54 and the spacing between the operating arm portions or dogs 98 and 100 are coordinated so that the increments of travel during which the operating arm 72 effects opening and closing of contact set 30, 48 and the increment of its travel during which it effects opening and closing of the contact set 50, 52 are separated sufficiently so that the contacts 30, 48 may be cycled, that is repeatedly opened and closed, without effecting the positioning of the alarm contacts.

Figure 8:
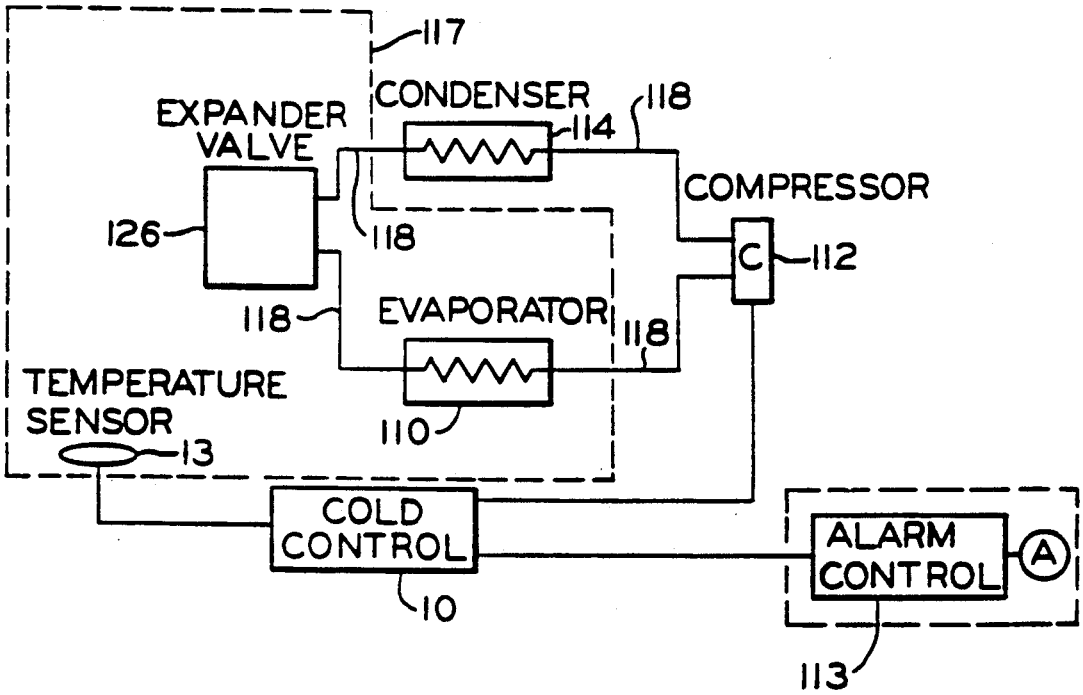
FIG. 8 is a diagrammatic view of a refrigeration appliance in which the condition responsive switching apparatus illustrated in FIG. 1 can be advantageously used.

A switching apparatus 10 embodying the present invention, such as that described above, is of substantial advantage when used as a cold control for controlling the operation of a refrigeration appliance such as a freezer. For the purpose of illustrating its use in such an environment, there is shown in FIG. 8 a freezer system in simplified schematic form. The system includes an evaporator 110, a compressor 112, a condenser 114 and an expander 116, all connected together by suitable tubing 118 to form a circulating system for a suitable refrigerant. The temperature sensor 13, in the illustrated embodiment a capillary tube, provides a signal indicative of the actual temperature of the freezer compartment 117 to the cold control 10. The cold control 10 based on the temperature signal and the operator setting (not shown) energizes the compressor 112 in a cyclic manner to operate the refrigeration cycle, energizes the alarm circuit 113 to signal a malfunction, or disables both during a defrost mode.

Figure 9:
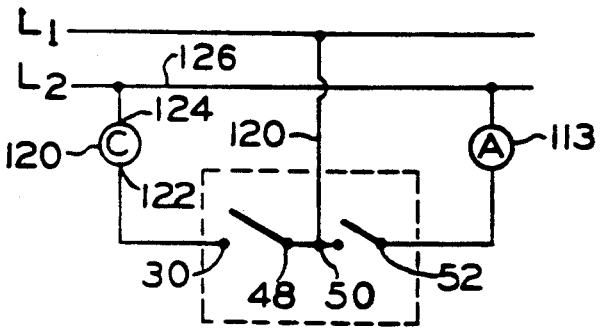
FIG. 9 is an electrical schematic diagram of the cold control and alarm system for the refrigeration appliance illustrated in FIG. 8.

FIG. 9 illustrates an electrical schematic of the switching apparatus 10 connected as the freezer control. The control contact set 30, 48 forms a SPST switch which is connected between a power supply line 120 and the hot or ungrounded terminal 122 of the compressor 112. The other terminal 124 of the compressor 112 is the cold or grounded side of the power supply, line 126. Normally, for single phase, AC power these connections are termed L1 and L2 and have white and black colored wires, respectively. When the temperature rises, the control contact set 30, 48 is closed to operate the compressor 112 and perform cooling. When the temperature drops below the cooling temperature, the control contact set 30, 48 will open, disengaging the compressor 112 and stopping any further cooling.

The alarm contact set 50, 52 is connected in a similar manner between the two power supply terminals 120, 126 in series with an alarm circuit 113. Closing the alarm contact set 50, 52 causes an energization of the alarm circuit 113 and a warning that one of the system components of the freezer is likely inoperative. The alarm circuit 113 can take various forms and provide either a visual or audible alarm. Further, such alarm circuit 113 could be equipped with an alarm control to signal other apparatus of the alarm condition, or store relevant failure data. The alarm contact set 50, 52 is independent of the operation of the control contact set 30, 48 so that an alarm signal will be given whatever the status of the control contact set. Further, the alarm temperature calibration will not change due to control contact erosion over many cycles because of their independent configuration.

Figure 10:
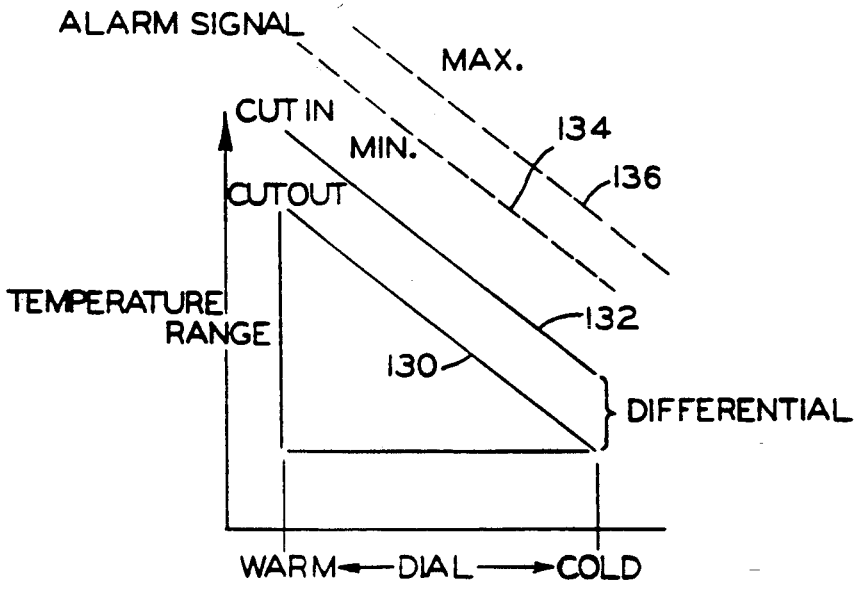
FIG. 10 is a pictorial representation of the cold control schedule and the alarm schedule of the condition responsive switching apparatus illustrated in FIG. 1.

FIG. 10 is a pictorial representation of the range of control of the switching apparatus 10 showing the "cut in" and "cut out" temperatures of the compressor 112 separated by the temperature differential as set by the adjustment of screw 80. The cut in temperature is set by adjustment of screw 90. The calibration schedule of the control, once these parameters are set, are shown as lines 130, 132 and are adjustable over a range of temperatures by adjusting the rotation of shaft 17. Above the cut in temperature schedule is an adjustable alarm schedule provided by the alarm contact set 50 and 52. The present implementation provides an alarm calibration schedule which is a predetermined temperature differential above the compressor cut in schedule 132.

Further, the preload set screw 68 which regulates the preload force on the alarm spring is used to regulate the calibration between a minimum schedule 134 and a maximum schedule 136.

Figure 11:
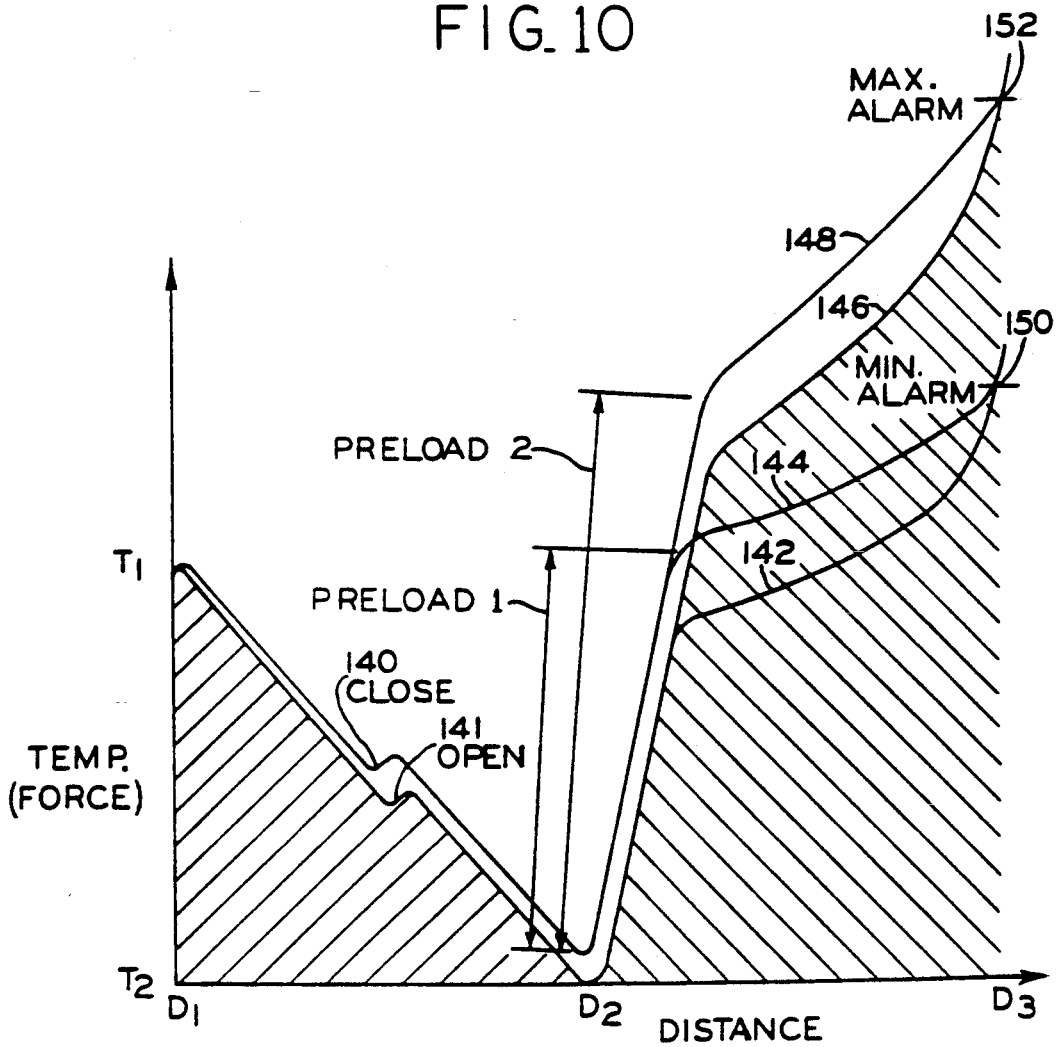
FIG. 11 is a pictorial representation of the force-movement operating characteristics of the first embodiment of the condition responsive switching apparatus illustrated in FIG. 1.

FIG. 11 illustrates the advantageous effect of the preload force on the operation of the switching apparatus 10. The figure is a force versus distance graph as applied to the contact operator 72. Normally, the contact operator 72 moves with a snap-action between the first position (cut out or $T_1$) and the second position (cut in or $T_2$) in a cyclic manner as shown by the left half of the graph. When the temperature increases to $T_1$, the snap-action of the operator 72 moves it to the "cut in" position D2 and operates the control contacts (closed) intermediate of the extreme positions at 140. Likewise, when the temperature decreases to $T_2$, the snap-action of the operator 72 moves it to the cut-out position D1 and operates the control contacts (open) intermediate of the extreme positions at 141. While the stop 102 absorbs the energy of the snap-action when the apparatus moves to the cut out position, there is no stationary stop at the cut in position and the operator 72 bumps against the alarm spring 54. The kinetic energy of the moving operator 72 can be equated to the triangular area bounded by the $T_1$, $T_2$ temperatures and the cut in distance D2.

If this energy is not dissipated, the alarm switch contacts will close and give a false alarm. The preload force absorbs this energy and will not let the operator move beyond the second position until it is overcome. Further, if the alarm contacts would close with less of a rise in temperature than from $T_2$-$T_1$, then there could be no automatic cycling as a false alarm would be sounded every time after the cut out cycle. Therefore, for proper operation a preload force is applied to the alarm spring which requires a temperature in excess of $T_1$ to overcome and which has an energy absorption capability (cross-hatched area under curves 144 or 148) which is greater than the kinetic switching energy.

After the preload force is overcome, the operator 72 may move the alarm spring contact 52 toward the stationary contact 50 according to the spring gradient of the moveable arm to the minimum alarm temperature 150 along curve 144. When the temperature decreases, the operator follows curve 142 back to the cycling operation. The maximum alarm point 152 can be reached by adjusting set screw 86 for maximum preload, preload 2. In this instance the operator 72 will move along curve 148. Relaxation of the alarm spring 54 from the maximum alarm point 152 will occur along curve 146. Thus, in this embodiment a base preload (minimum) is increased by set screw 68 to a maximum.

Figure 12:
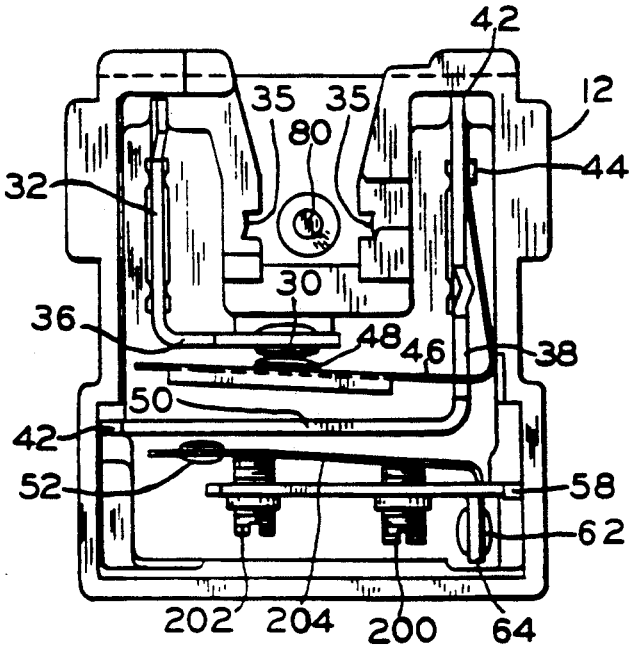
FIG. 12 is a reverse end view of the insulative base section of a second embodiment of the condition responsive switching apparatus illustrated in FIG. 1, with some parts removed to show certain operational aspects of the apparatus, taken along view lines 4—4 of that figure.

FIG. 12 discloses an alternative implementation of the switching apparatus 10. Illustrated in the figure is the base 12 of the apparatus 10 with the two switching contact sets, one for control and the other for alarm, mounted therein. The assembly of the base 12 in the switching apparatus 10 for this embodiment is identical to that described for the base shown in FIG. 4. The control contact set is configured similarly to the first embodiment in FIG. 4 with a stationary contact element 30 and a moveable contact element 48 staked to a leaf spring 46. The alarm contact set is also configured similarly to the first embodiment with a stationary contact element 50 and a moveable contact element 52 staked to the moveable arem of an alarm spring 204. However, in this embodiment, the preload force of the alarm spring 204 is built into the spring by bending it at an acute angle to horizontal. This produces a stress or preload force which the dog 100 on the contact operator 72 must overcome prior to being able to follow the gradient of the spring. As was the case in the first embodiment, the alarm contact set 50, 52 is provided with adjustment means for varying the alarm calibration. A first adjustment means, comprising set screw 202, is used to vary the distance between the contacts 50, 52 and thus the amount by which the contact operator 72 must move to close the contacts. A second adjustment means, comprising set screw 200, applies a subtractive force against the preload force of the alarm spring 204 by pushing up on it. This force is in the direction to assist the contact operator 72 in closing the alarm contact set 50, 52 and, therefore, reduces the preload force in an adjustable manner.

The operation of the second embodiment will now be more fully explained with reference to FIGS. 13 and 14. The contact operator 72 moves as described previously under the influence o the bellows assembly 20, the range spring 88, and the toggle spring 78. The contact operator 72 generally cycles between a first position D1 where the control contact set is open and a seond position D2 where the control contact set is closed. When the temperature rises due to some system component failure, the contact operator 72 will move from the second position D2 toward a third positIon D3 where it closes the alarm contact set.

Figure 13:
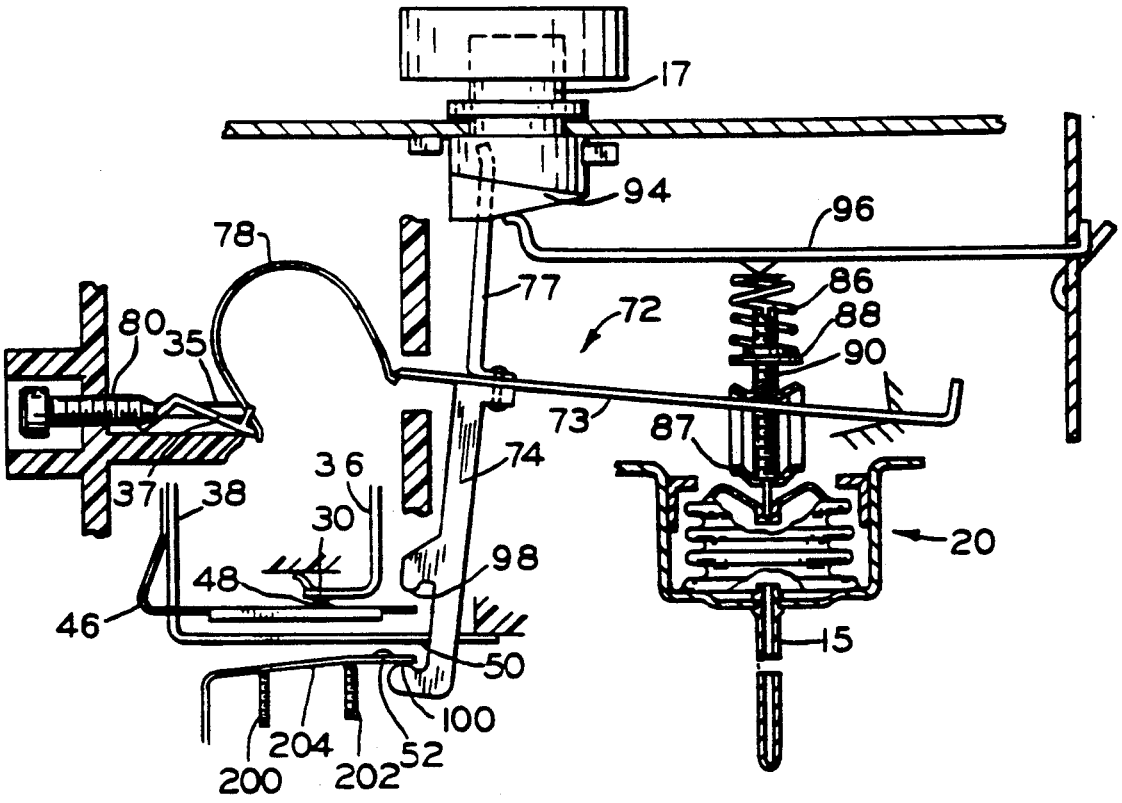
FIG. 13 is a semi-schematic side elevation view of the second embodiment of the condition responsive switching apparatus illustrated in FIG. 1 showing the contact operator in the second position.
Figure 14:
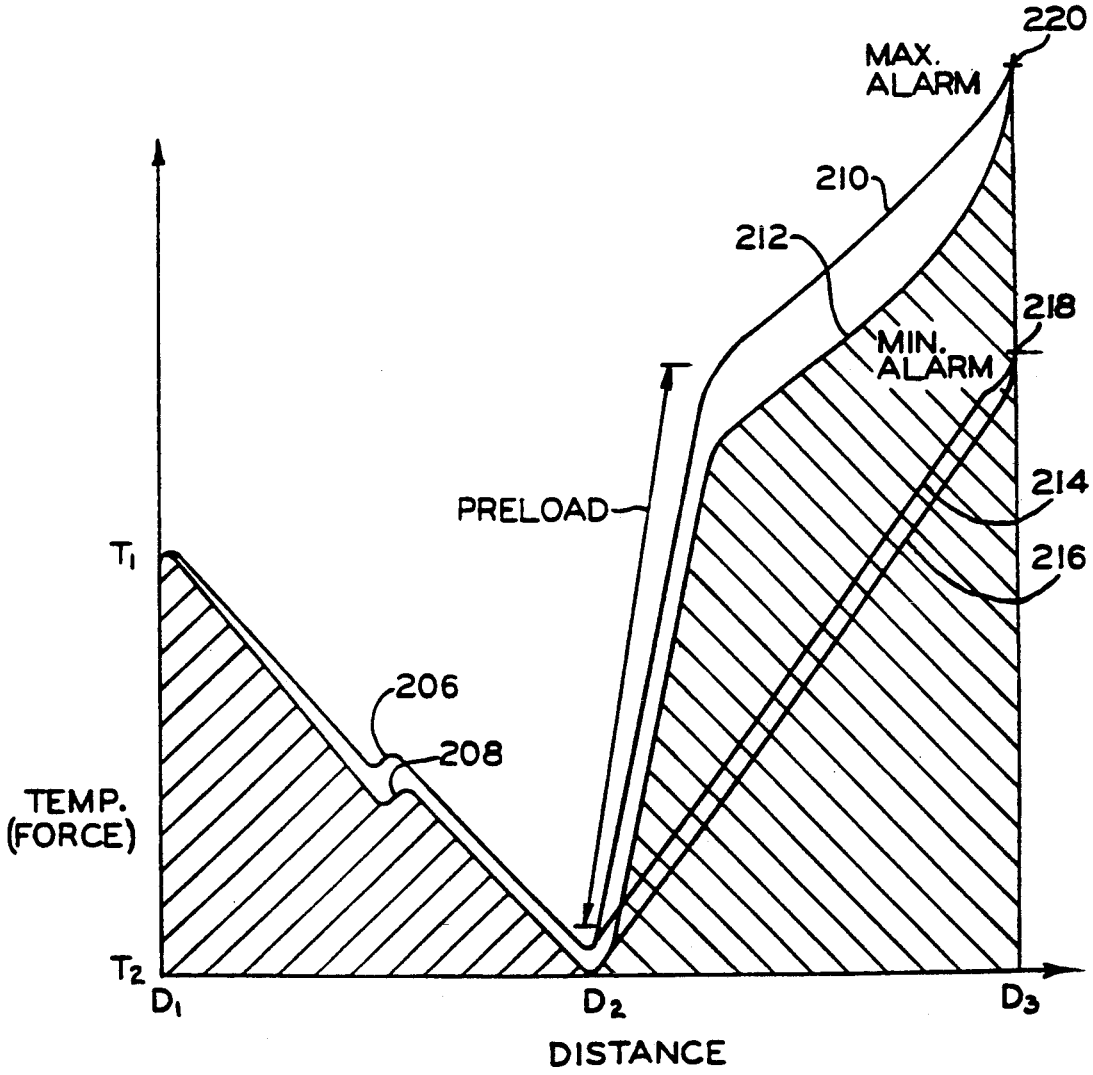
FIG. 14 is a pictorial representation of the force-movement operating characteristics of the second embodiment of the condition responsive switching apparatus illustrated in FIG. 1.

FIG. 14 illustrates a representative force-movement curve for the embodiment illustrated in FIGS. 12 and 13. The curves on the left hand side represent the cycling portion of the graph where points 206, 208 are the contact closing and opening occurrences, respectively, as the contact operator snaps between its first and second positions D1, D2. Curve 210 is the maximum alarm temperature curve where the contact operator 72 must overcome the preload built into the alarm spring 204 before the gradient portion is reached. The maximum alarm temperature is at 220. Relaxation of the alarm spring 204 from this point is along curve 212. The preload force can be adjusted downward from this maximum, until there is no preload force, or anywhere in between by set screw 200. The minimum alarm curve 214 is shown to reach the minimum alarm point 218 where all the preload force has been taken out of the alarm spring 204 by adjusting the set screw 200. Relaxation from the minimum alarm point is along curve 216. It is noted that adjustment of the alarm temperature should not cause the area under curves 214, 210 to be less than the kinetic energy of the operator 72 or the switching apparatus 10 will cycle through both switches and give false alarms. In this sense, this embodiment is somewhat more limited than the first embodiment in providing an alarm temperature close to the cycling temperature $T_1$.

While the preferred embodiments of the invention have been shown and described in detail, it will be obvious to those skilled in the art that various modifications and changes may be made thereto without departing from the spirit and scope of the invention as is hereinafter defined in the appended claims.

What is claimed is:

1. A condition responsive switching apparatus comprising:

a first stationary control contact and a first moveable control contact operatively supported for movement between open and closed positions;

a first stationary alarm contact and a first moveable alarm contact operatively supported for movement between open and closed positions;

contact operator means for opening and closing the moveable and stationary control contacts as the contact operator means moves between a first position and a second position, and for opening and closing the alarm contacts as the operator means moves between the second position and a third position, the contact operator means including means for producing a snap action increment of movement of the operator means intermediate the first and the second positions; and condition responsive means, operatively connected to the operator means, for moving the operator means between the first, the second, and the third positions in response to predetermined sensed conditions.

2. A condition responsive switching apparatus comprising:

a first set of switching contacts adapted for movement between open and closed positions;

a second set of switching contacts adapted for movement between open and closed positions;

contact operator means for effecting the opening and closing of the first set of switching contacts and of the second set of switching contacts, the contact operator means including means for producing a snap action increment of movement of the operator means which effects the opening or closing of one of the first and second sets of switching contacts;

condition responsive means for effecting movement of the contact operator means in response to predetermined sensed conditions; and means for absorbing the energy of the contact operator means as it moves in the snap action increment without restraining the operator means from effecting the opening or closing of the other of the first and second sets of switching contacts, the energy absorbing means including a resilient member biased with a preload force to oppose motion of the contact operator means beyond the snap action increment until the preload force is overcome.

3. The apparatus of claim 2 wherein the resilient member further comprises:

a spring gradient to oppose motion of the contact operator means beyond the snap action increment after the preload force is overcome.

4. The apparatus of claim 3 wherein the resilient member comprises a moveable arm of a contact of one of the first and second sets of switching contacts.

5. The apparatus of claim 3 wherein, the other set of switching contacts includes a stationary contact element, a moveable contact element on a moveable arm, and the energy absorbing means; and the moveable arm of the moveable contact element being a spring element.

6. The apparatus of claim 5 further comprising:

means for adjusting the distance between the moveable contact and the stationary contact.

7. The apparatus of claim 6 further comprising:

means for providing an adjustable preload force on the spring element.

8. The apparatus of claim 7 wherein the means for adjusting the distance further comprises:

an adjustable set screw which biases the spring element towards the stationary contact.

9. The apparatus of claim 8 wherein the spring element is cantilevered from a stationary connection element and the adjustable preload providing means includes an adjustable set screw which biases the spring element away from the stationary contact.

10. The apparatus of claim 9 wherein the distance adjusting set screw is spaced away from the stationary connection element and pushes the spring element towards the stationary contact.

11. The apparatus of claim 10 wherein the preload adjusting set screw is spaced away from the stationary connection element intermediate of the distance adjusting set screw and the connection element and pulls the spring element toward the distance adjusting set screw.

12. The apparatus of claim 8 wherein the spring element is cantilevered from a stationary connection element and the preload providing means includes an adustable set screw which biases the spring element toward the stationary contact.

13. The apparatus of claim 12 wherein the distance adjusting set screw is spaced away from the stationary connection element and pushes the spring element toward thestationary contact.

14. The apparatus of claim 13 wherein, the preload adjusting set screw is spaced away from the stationary connection element intermediate of the distance adjusting set screw and the connection element and pushes the spring element away from the distance adjusting set screw.

15. A control system for an appliance operatively connected to a circuit for providing cooling to the appliance and an alarm circuit for generating an indication of an over-temperature condition of the appliance, the control system comprising:

at least one control contact electrically connected for selectively energizing and de-energizing a compressor and supported for movement between open and closed circuit positions;

temperature responsive force producing means, operatively connected to a temperature sensor, for producing a temperature responsive force;

mannually adjustable force providing means for providing an adjustable force based on a manual setting to oppose or assist the force developed by the temperature responsive force producing means;

contact operator means and a snap acting toggle device arranged for co-acting with one another and for producing snap action incremental movement of the contact operator means in two different directions, the contact operator means being stopped in at least one of the two different directions;

force transfer means, operatively connecting the temperature responsive force producing means and the manually adjustable force providing means to the contact operator means, for effecting snap-action incremental movement of the contact operator means based on a sensed temperature and the manual setting;

said control contact means being moved between open and closed circuit positions by the snap action incremental movement of the contact operator means; and alarm contacts arranged foir selectively activating and inactivating an alarm circuit, said alarm contacts being urged to a closed circuit condition in response to force produced by the temperature responsive force producing means in excess of the force of the temperature responsive force producing means that triggers snap-action movement of the contact operator means.

16. The control system of claim 15 wherein the contact operator means includes a contact operating arm having dog means for moving the control contact to an open circuit condition when the contact operator means moves in one of said two different and for moving the control contact to a closed circuit condition when the operator means moves in the other of said two directions; and wherein the alarm contact is spring biased to an open circuit condition, but moveable to closed circuit condition in response to engagement by said dog means.

17. The control system of claim 15 wherein the system further comprises a moveable alarm contact arm and a stationary alarm contact arm.

18. The control system of claim 17 wherein the system further comprises means for preloading the moveable alarm contact arm.

19. The control system of claim 16 wherein the alarm contact is carried by a moveable spring arm having a predetermined alarm gradient.

20. The control system of claim 19 further comprising means for providing a preload force on the moveable spring arm.

21. The control system of claim 20 further comprising means for adjusting the preload force.

22. The control system of claim 21 wherein the means for adjusting the preload force further comprises at least one adjusting screw.

* * * * *